US006039493A

United States Patent [19]

Seddon et al.

[11] Patent Number: 6,039,493

[45] Date of Patent: Mar. 21, 2000

[54] BALL POINT PEN

[75] Inventors: Mark Arthur Seddon, Reading; Clive Barnes, Comnor, both of United Kingdom

[73] Assignee: The Gillette Company, Boston, Mass.

[21] Appl. No.: 09/253,992

[22] Filed: Feb. 22, 1999

Related U.S. Application Data

[63] Continuation of application No. PCT/US97/16272, Oct. 7, 1997.

[30] Foreign Application Priority Data

Oct. 8, 1996 [GB] United Kingdom ..... 9620985

[51] Int. Cl.[7] ..... B43K 7/00

[52] U.S. Cl. ..... 401/209; 401/216

[58] Field of Search ..... 401/209, 208, 401/216, 215, 212

[56] References Cited

U.S. PATENT DOCUMENTS

| | | | |
|---|---|---|---|
| 2,487,340 | 11/1949 | Kleinsmith | 120/42.4 |
| 2,592,406 | 4/1952 | Falton . | |
| 3,032,012 | 5/1962 | Lovejoy | 120/42.03 |
| 3,094,105 | 6/1963 | Jenkins | 401/209 X |
| 3,352,621 | 11/1967 | Fehling et al. | 401/109 |
| 5,012,663 | 5/1991 | Brown | 72/369 |

FOREIGN PATENT DOCUMENTS

| | | | |
|---|---|---|---|
| 79099 | of 1950 | Czechoslovakia . | |
| 1032122 | 6/1953 | France . | |
| 1458917 | 1/1967 | France . | |
| 1585676 | 1/1970 | France . | |
| 1293650 | 4/1969 | Germany . | |
| 2452807 | 5/1976 | Germany | 401/209 |
| 5-58358 | of 1993 | Japan . | |
| 877340 | 9/1961 | United Kingdom | 401/209 |
| 988740 | 4/1965 | United Kingdom . | |
| 9116210 | 10/1991 | WIPO . | |
| 9722482 | 6/1997 | WIPO . | |

*Primary Examiner*—David J. Walczak
*Attorney, Agent, or Firm*—David A. Howley

[57] ABSTRACT

A ball point pen has a hollow nib member (2) attached to the end of a cylindrical body (1) enclosing a ink reservoir (3), the forward end of the nib member being spaced from the axis (B) of the body and having a tip element (4) welded thereto so that the writing ball (6) incorporated in the tip is located on the same side of the axis (B) as the forward end of the nib member.

9 Claims, 2 Drawing Sheets

BALL POINT PEN

This is a con of PCT/U.S. 97/16272 filed on Oct. 7, 1997.

This invention relates to writing instruments and in particular concerns a ball point pen, i.e. a pen with a rotatable ball for contacting the paper during writing. Ball point pens have been in use for many years and are very popular with users. Nonetheless they are not without some drawbacks. Most ball point pens in production and available on the market have their ball tip elements directed axially of the pen barrel from which they project. As a result of this arrangement the tip elements operate most efficiently when the pens are held perpendicular to the paper. It is usual, however, for a pen to be held during writing in an inclined orientation, typically at an angle of about 30° to the perpendicular. In the case of some users who have a tendency to hold a pen at a low angle of slope to the paper, the rim surrounding the ball can contact the paper and interfere with the smooth operation of the ball, and even wear away the rim so that the ball becomes loosened. In view of these drawbacks there have been numerous proposals to arrange the ball tip element to be inclined to the main axis of the pen barrel so that, when the pen is held for writing, the tip element is substantially vertical relative to the paper. However, despite these many proposals a commercially acceptable form of ball point pen with an angled tip element has yet to be produced.

The present invention addresses the shortcomings of the prior art proposals and in accordance with the invention there is provided a ball point writing instrument comprising an ink reservoir within a generally cylindrical body having a longitudinal axis, a hollow nib member connected to a forward end of the body and projecting therefrom, the nib member having a leading end spaced laterally from the axis of the body, and a tip element including the writing ball attached to the leading end of the nib member and extending therefrom towards the axis of the body, the writing surface of the ball being spaced from the axis of the body in the same direction as that in which the leading end of the nib member is spaced from said axis.

Some of the prior art proposals for ball point pens with angled tip elements rely on special asymmetrical barrel configurations at the forward end where the nib section protrudes. Generally speaking users prefer regular barrel shapes i.e. substantially cylindrical and/or rotationally symmetrical forms, with which they are familiar and feel comfortable. Consequently irregular barrel shapes, as suggested for example by WO 91/16210, are unlikely to prove acceptable to users. In contrast the writing instrument of the invention can have a conventionally shaped, e.g. rotationally symmetrical barrel.

Other prior art proposals for ball point pens with angled tips have elongate refills with bent tip sections mounted within barrels configured to hold the refills in predetermined positions. The special configuration of the barrel, e.g. according to U.S. Pat. No. 3,352,621, can complicate the barrel manufacture, and the need to be able to replace the refill can further complicate the barrel construction, leading to increased manufacturing costs. Furthermore, the refills in these pens consist of narrow tubes which are able to store relatively small volumes of ink, much of the space within the confines of the barrel being wasted. The invention of the present application enables a relatively large volume of ink to be stored in the ink reservoir within a pen barrel of conventional shape and size.

Many of the prior art proposals result in the ball of the angled tip element having its exposed writing surface on or spaced from and directed away from the axis of the pen body. It has been found that such arrangements have poor performance and that the performance is substantially improved with the ball surface located so that, during writing, it is located above the body axis. With such a tip configuration according to the invention, visibility of the tip during writing is good, and there is a reduced tendency for the body to be rotated about the point of contact between the ball and paper since the body axis is below the contact point rather than above it.

In the ball point writing instrument of the invention the nib member and body to which it is attached can form a substantially rigid structure, facilitating use as a disposable pen to be discarded when the reservoir has become depleted, or as a refill within a re-usable barrel, possibly incorporating a retraction mechanism as well known per se.

To facilitate a full understanding of the invention, a particular embodiment is described below with reference to the accompanying drawings in which.

Figure 1:
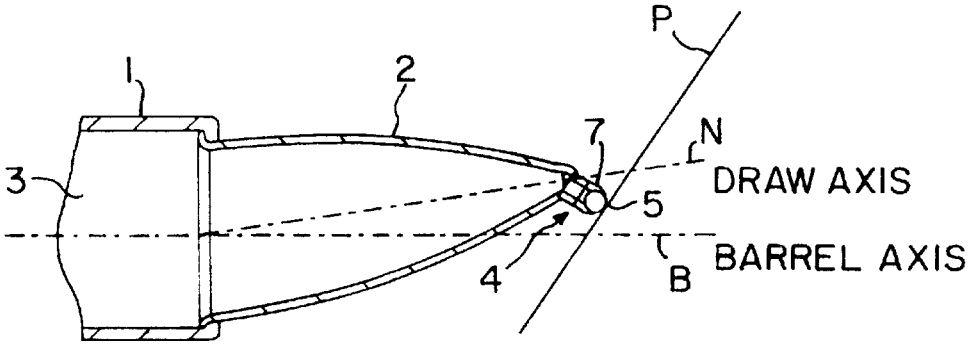
FIG. 1 is an axial section through the forward end of a ball point assembly of a writing instrument according to the present invention.

The ball point assembly illustrated in FIG. 1 has a body, to which a nib member 2 is firmly attached to project forwardly from the front end of the body. The body confines a chamber 3 for storing a supply of ink for delivery through the nib member to the ball point tip element 4 fixedly secured to the leading end of the nib member. The assembly may be part of a disposable pen, in which case the body 1 can constitute the pen barrel which is held during writing. Alternatively the assembly may be part of a so-called refill which is intended to be disposed within a re-usable pen barrel and to be replaced when the reservoir has been emptied of ink.

The body defines an axis B (inherently also the axis of chamber 3), which will coincide with the pen barrel axis. The nib member 2 is hollow with a cross section which tapers towards the forward end substantially uniformly with respect to the axis N of this member. The rear or trailing end of the nib member surrounds and is substantially concentric with the barrel axis B, but the nib axis N is inclined to the barrel axis so that the leading end of the nib member is positioned laterally away from the barrel axis. The inclination between the axes B and N may be in the range of 5° to 10°, e.g. about 8°. The tip element 4, which includes the writing ball 6 held within the end of a short tube 7, is attached to the leading end of the nib member so that the tip element extends towards the barrel axis B at an angle of about 30° to that axis, but the ball surface is still spaced from the axis B so that when the ball is placed against a sheet of paper P during writing the axis B is below the point of contact between the ball and paper.

Figure 3:
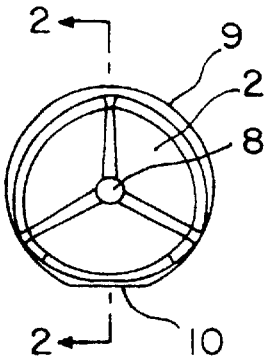
FIG. 3 is a front end elevation of the component shown in FIG. 2.
Figure 2:
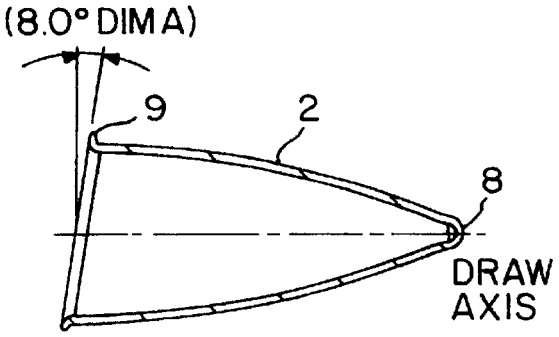
FIG. 2 is an axial section through a deep drawn component used in the manufacture of the nib member of the ball point assembly.
Figure 4:
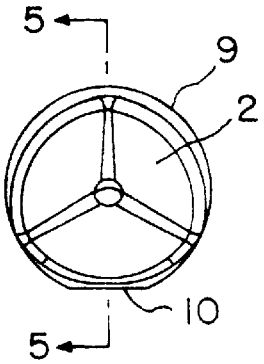
FIG. 4 is a front elevation of the component following removal of a front end section ready for attachment of the angled tip element.
Figure 5:
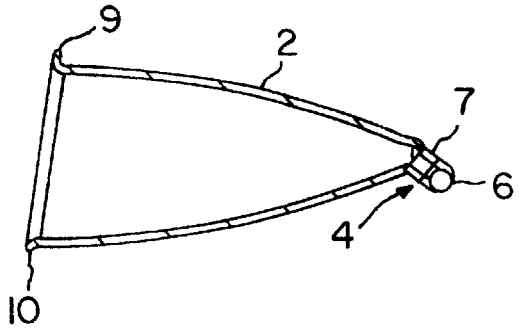
FIG. 5 is an axial section showing the tip element secured to the nib member.

The nib member 2 is conveniently manufactured as a deep drawn component as shown in FIGS. 2 and 3. It is formed with a part-spherical leading end 8 positioned on axis N and at the trailing end is formed with an external flange 9 lying in a plane which is inclined at about 8° away from the perpendicular to the axis of draw. After a section of the leading end has been removed, such as by grinding, to leave a circular edge (FIG. 4), the tube 7 of the tip element 4 is laser welded to this edge so that the tip element is angled to the nib member axis N as shown in FIG. 5. The flange 9 of the nib member is provided with a flat 10 for rotational alignment purposes. The nib member with the attached tip element is firmly assembled with the body 1, the flange of the nib member abutting a circular lip on the body to ensure the required inclination of the nib member axis N to the barrel axis B a described above. There are, of course, other ways to ensure the canted orientation of the nib member relative to the axis B. It is not essential for the nib member to be rotationally symmetrical to the axis N, but for convenience of manufacture it preferably tapers in a manner which is uniform with respect to the axis. It is preferred that the nib member should be contained wholly within an imaginary cylinder coaxial with the body and having the same diameter as the forward end of the body, which can ease positioning within a re-usable barrel and may be of further benefit when a retraction mechanism is provided for selectively advancing and retracting the writing point with respect to a forward end of the barrel.

Figure 6:
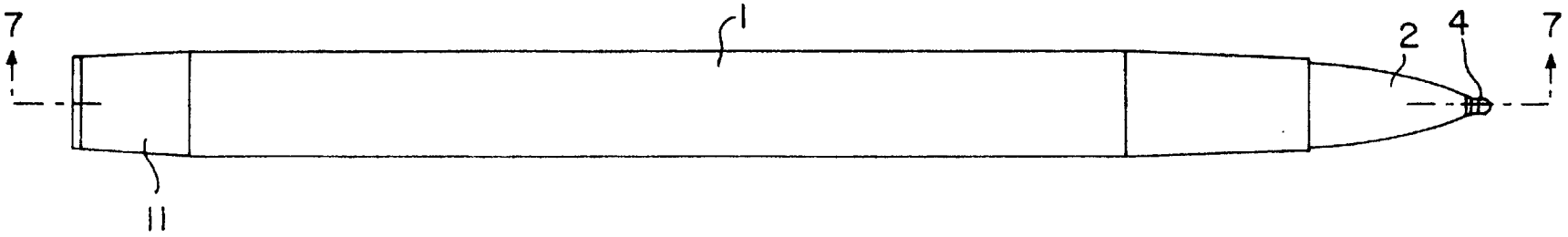
FIG. 6 is a plan view of a ball point refill manufacture in accordance with the invention.
Figure 7:
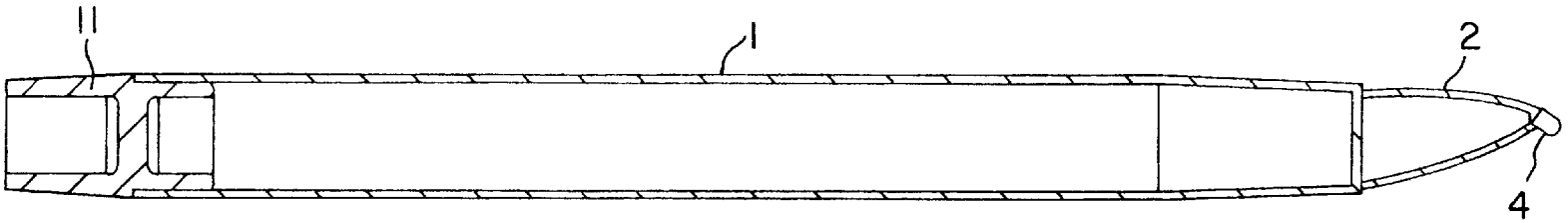
FIG. 7 is an axial section through the refill of FIG. 6.

FIGS. 6 and 7 illustrate a ball point refill unit having a ball point assembly as described above. The refill includes a cylindrical deep drawn body to the forward end of which the ball point assembly is securely fastened. The rear end of the body is closed by a plug 11 which is conveniently made as a plastics moulding. The refill can be used in a pen barrel incorporating a retraction mechanism as well known in the art.

What is claimed is:

1. A ball point writing instrument comprising an ink reservoir within a generally cylindrical body, a hollow nib member connected to a forward end of the body and projecting therefrom, a portion of the reservoir immediately adjacent the nib member having a longitudinal axis, the nib member having a leading end positioned on a longitudinal axis of the nib member and spaced laterally from the axis of the reservoir, and a tip element including the writing ball attached to the leading end of the nib member and extending therefrom towards the axis of the reservoir, the writing surface of the ball being spaced from the axis, in the same direction as that in which the leading end of the nib member is spaced from said axis.

2. A ball point writing instrument according to claim 1, wherein the tip element is welded to the leading end of the nib member.

3. A ball point writing instrument according to claim 1, wherein the rear end of the nib member is concentric with the axis of the body.

4. A ball point writing instrument according to claim 1 wherein the nib member has an axis of taper inclined to the axis of the body.

5. A ball point writing instrument according to claim 4, wherein the angle at which said axes are inclined is in the range 5° to 10°.

6. A ball point writing instrument according to claim 1, wherein the nib member is contained within an imaginary cylinder having a diameter of the forward end of the body and coaxial therewith.

7. A ball point writing instrument according to claim 1 wherein the nib member is a deep drawn component.

8. A ball point writing instrument according to claim 1, wherein the nib member and body form a substantially rigid structure.

9. A ball point writing instrument according to claim 1, wherein the body is received coaxially within an outer barrel.

* * * * *